US006603067B1

(12) United States Patent
Woollen

(10) Patent No.: US 6,603,067 B1
(45) Date of Patent: Aug. 5, 2003

(54) STAND FOR SUPPORTING A MUSICAL INSTRUMENT

(76) Inventor: Jeffrey Kent Woollen, 17115 Vashon Hwy. SW., Vashon, WA (US) 98070

( * ) Notice: Subject to any disclaimer, the term of this patent is extended or adjusted under 35 U.S.C. 154(b) by 0 days.

(21) Appl. No.: 10/254,435

(22) Filed: Sep. 25, 2002

(51) Int. Cl.[7] ..... G10D 3/16
(52) U.S. Cl. ..... 84/327; 248/176.1
(58) Field of Search ..... 84/327, 421, 329; 248/166, 434, 168, 176.1, 178.1

(56) References Cited

U.S. PATENT DOCUMENTS 3,958,786 A * 5/1976 Mann ..... 248/176.3
4,693,161 A 9/1987 Uhrig
5,165,634 A * 11/1992 Garbuzov et al. ..... 248/166
5,197,701 A 3/1993 Olson
6,130,375 A * 10/2000 Kellogg et al. ..... 84/327
6,220,459 B1 * 4/2001 Runyon ..... 211/85.6
6,422,522 B1 * 7/2002 Woollen ..... 248/166

* cited by examiner

*Primary Examiner*—Kimberly Lockett

(57) ABSTRACT

A stand (10) for supporting a musical instrument (12), such as a guitar, in an upright position when not in use and for retention on the instrument when the instrument is in use. The stand comprises a mounting block (22) secured to the bottom edge (20) of the instrument (12), and a flat stand member (24) pivotally connected to the mounting block (22). Flat stand member (24) can be transitioned between a first, closed position adjacent the rear surface (18) of the instrument (12) and a second, open position spaced away from the rear surface (18) of the instrument (12) where it supports instrument (12), and is spring-loaded such that it automatically returns to the first, closed position when the instrument (12) is lifted for use. A retaining clip (26) and catch assembly (32) cause the stand (10) to lock into open position when positioned on a horizontal surface.

3 Claims, 6 Drawing Sheets

STAND FOR SUPPORTING A MUSICAL INSTRUMENT

CROSS-REFERENCE TO RELATED MATERIAL

Not applicable.

BACKGROUND

1. Field of Invention

This invention relates to musical instrument stands, specifically to a musical instrument stand for enabling the instrument to remain in an upright position when not in use and which is retained on the instrument when the instrument is in use.

BACKGROUND

2. Description of Prior Art

Musicians are often faced with the challenge of temporarily supporting their instrument when it is not being played. Instruments such as guitars are subject to potential damage if simply laid flat on the floor, so it is common practice to lean the neck or head of the instrument against a piece of furniture or a wall.

Leaning the neck of such an instrument against a piece of furniture or the like often results in the upper part of the instrument sliding laterally, causing the entire instrument to fall to the floor, again resulting in damage to the instrument. Leaning the head of such an instrument against a wall or a piece of furniture has the added disadvantage of potentially putting the instrument out of tune due to the tuners in the head coming in contact with the wall or furniture.

Conventional stands for musical instruments have been free standing devices which rest on the floor, into which the instrument is placed when not in use. While some of these stands are collapsible to some degree, they still represent an additional piece of equipment the musician must deal with, requiring time, effort and space to transport, store, deploy and use.

Four types of stands which are retained on the musical instrument in a collapsed configuration while the instrument is being played, and which can then be deployed as a stand when the instrument is not in use have been proposed. Of these, three require a degree of manual manipulation to either deploy or to store. Since convenience is major factor necessitating such a stand, the importance of automatic or semi-automatic operation is significant.

One device, U.S. Pat. No. 5,197,701 by Olson is a mechanically complex device. While it does include spring loaded legs which are automatically released when the bottom end of the guitar is placed on the floor, it requires that the same legs be manually forced back into their housing, against the pressure of the springs, before the musical instrument can be used. In the case of the guitar or other similar instrument, there is no practical way to hold the instrument to apply an opposing force necessary to accomplish this act. These instruments can easily be held by their neck, but this would be difficult due to the leverage provided by the length of the neck it is not easy to adequately grip such an instrument in the midst of it's body, where the opposing force is required.

In addition to the disadvantage of this difficulty in returning the collapsible legs to their stored position, the device suffers from an overly complex mechanical design, causing a number of other disadvantages:

(a) The tooling, manufacture and assembly for the device would be expensive. The design requires numerous custom made parts which need to adhere to close tolerances in order for the device to function properly. The labor required to assemble the numerous parts would be relatively costly.

(b) The mechanical complexity of the device would render it subject to potential breakdowns requiring repair or replacement.

(c) Several sliding and pivoting parts could require periodic lubrication. Lubricants attract and retain dust and dirt, and this dust and dirt would be easily transferred to the clothing of the user, especially when playing the instrument, at which time the device is in actual contact with the user's clothing.

(d) The mechanical complexity of the device contributes to an overall bulky and obtrusive appearance. This has both an aesthetic and a practical impact: Aesthetic since the device is visually obtrusive, and practical since the bulkiness of the device causes interference against the user's body when the instrument is being played.

Another device, U.S. Pat. No. 4,693,161 by Uhrig, is a simpler device, but suffers from several major disadvantages:

(a) The device is attached to the musical instrument by the means of the screws which hold the neck of the instrument to the instrument body. Loosening these screws in order to mount the device can cause misalignment of the neck and body of the instrument, resulting in a number of functional problems in the instrument.

(b) The supporting leg(s) is not spring mounted, thus manual manipulation is required for both deployment and collapsing of the device. While this solves one of the problems of the device previously cited, it adds another level of inconvenience to the user.

(c) Because the device is attached by screws at a predetermined point on the instrument, and the length of it's supporting leg is not adjustable, the device would be compatible only with those instruments where the distance from the neck-to-body attaching screws to the bottom of the instrument happens to match the length of the device's leg.

(d) The requirement of attaching the device at the point where the neck meets the body of the instrument requires the device span the entire length of the instrument body, resulting in a device that is both bulky and obtrusive.

(e) The requirement to attach the device by means of the screws which attach the neck to the body of the instrument would prevent the device from being used on those instruments, such as hollow-body acoustic guitars and the like, which do not incorporate screws as a means of attachment of the neck to the body of the instrument.

(f) The attachment by means of screws to any location on an instrument other than where screws already exist would result in the defacing of the instrument.

Yet another device, U.S. Pat. No. 6,130,375 by Kellogg et al. comprises an L-shaped bracket which is attached to the instrument via the instrument's strap-nut screw. A support member is hinged to the bracket and a retaining clip is manually manipulated by the user to either hold the support member in it's open position or to release the support member to it's stored position adjacent the back of the instrument. The device suffers a deficiency common to those previously cited:

(a) The user must manually manipulate the stand both to deploy and to disengage the stand. This requires no small degree of dexterity given that the user must raise the instrument with one hand and at the same time deploy or disengage the stand with the other. In the case of a guitar or other similar instrument, the only practical way to raise the instrument with one hand is to grasp the instrument by the neck, typically just below the head. From this position there is considerable leverage applied between the point where the user is grasping the instrument and the point where the stand is attached, causing difficulty in stabilizing the instrument sufficiently to apply the force necessary to deploy or disengage the stand.

Finally, U.S. Pat. No. 6,422,522 by Woollen proposes a mounting block which is attached to the back of the instrument with suction cups. A support member is attached to the block which swings out from the instrument to provide support. The support member is spring-loaded relative to the mounting block so it automatically returns to a stored position when the instrument is lifted for use. A spring-loaded center foot engages the floor as the instrument is retired from use, allowing the instrument to be pivoted away from the support member, thus deploying the stand. While this design solves the convenience problem that the previous citations suffer from by providing automatic deployment and disengaging, it suffers from one shortcoming:

(a) The attachment of the stand to the instrument by means of suction cups presents a stability and security question. If the suction cups were to come unattached while the stand is deployed, the instrument would suffer potential damage. Even given that the suction cups don't become unattached, the uncertainty of such an occasion would create hesitancy in the mind of the user and may thus challenge the market viability of the design.

SUMMARY

The present invention pertains to a stand for supporting a musical instrument, such as a guitar, in an upright position when the instrument is not being used. The stand remains attached to the instrument when it is being played. The device is both deployed and collapsed without direct manipulation by the user. The stand comprises an L shaped mounting block, a flat stand member joined to said mounting block by a clevis joint and hinge pin, and a retaining clip and catch mechanism whereby the flat stand member is retained in an open position. Said L shaped mounting block includes a slot or screw hole for attaching said block to the musical instrument using the screw and strap button typically found at the base of stringed instruments. Said flat stand member is spring loaded such that absent any force to the contrary, it returns to a closed position adjacent the back of the instrument, and includes a foot member which protrudes beyond the base of the instrument allowing the leveraging of the stand to an open position by engaging said foot member against a floor or other support surface. Said flat stand member further includes a catch mechanism which interferes with the travel of the retaining clip to retain the stand in the open position until the instrument is raised from the floor for use, at which time said catch mechanism releases said retaining clip and allows said flat stand member to return to the closed position.

It is therefore an object of the present invention to provide a support stand which is attached to a musical instrument, such as a guitar, for supporting the instrument in an upright position when the instrument is not in use, which can be stored unobtrusively on the instrument in a closed state while the instrument is being played, and be conveniently transitioned between closed and open positions without direct manipulation by the user.

Objects and Advantages

Accordingly, several objects and advantages of my invention are:

(a) to provide a stand for a musical instrument which allows for rapid, convenient deployment;

(b) to provide a stand for a musical instrument which stores unobtrusively on the instrument while the instrument is being played;

(c) to provide a stand for a musical instrument which requires no direct manipulation by the user;

(d) to provide a musical instrument stand which is mechanically simple and inexpensive to produce;

(e) to provide a musical instrument stand which uses a minimal number of parts;

(f) to provide a musical instrument stand which requires little or no maintenance;

(g) to provide a musical instrument stand which requires no lubrication;

(h) to provide a musical instrument stand which will fit instruments of varying sizes, types and shapes, and both solid-body and hollow-body guitars;

(i) to provide a musical instrument stand which can be easily removed and/or reattached from/to the same or a different instrument;

(j) to provide a musical instrument stand which attaches to the instrument without disturbing the instrument's integrity or appearance; and (k) to provide a musical instrument stand which is sleek, lightweight, compact, and thus easy to transport and store.

Further objects and advantages of my invention will become apparent from a consideration of the drawings and ensuing description.

DRAWING FIGURES

REFERENCE NUMERALS IN DRAWINGS

| | |
|---|---|
| 10 stand | 12 musical instrument |
| 14 instrument body | 16 instrument neck |

-continued

| | |
|---|---|
| 18 instrument rear surface | 20 instrument bottom edge |
| 22 mounting base | 24 flat stand member |
| 26 retaining clip | 28 foot member |
| 30 release tab | 32 catch assembly |
| 34 strap nut & screw | 36 base surface |
| 38 rib portions | 40 clip guides |
| 42 catch cam | 44A, B mounts |
| 46 spring | 48 spring retainer |
| 50 pin | 52 opening |
| 54A, B springs | 56 slot |

DESCRIPTION

Figure 1:
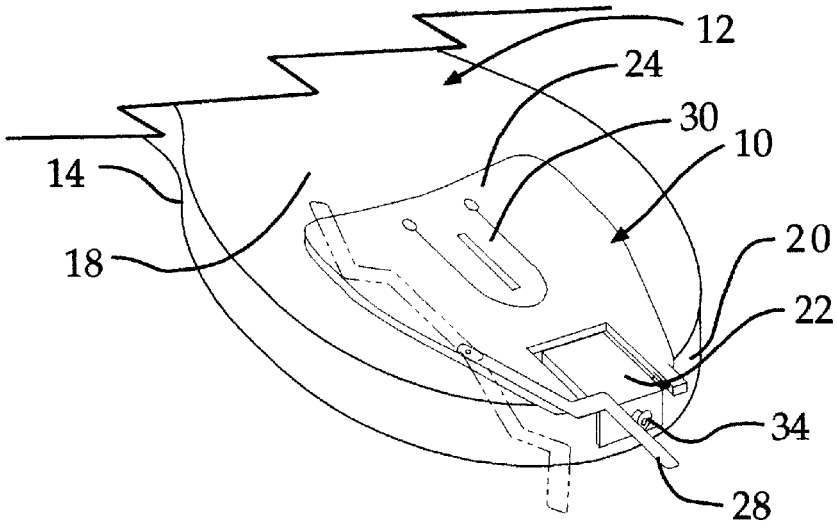
FIG. 1 is a perspective view of the stand mounted on a guitar, with the stand in a closed position.
Figure 2:
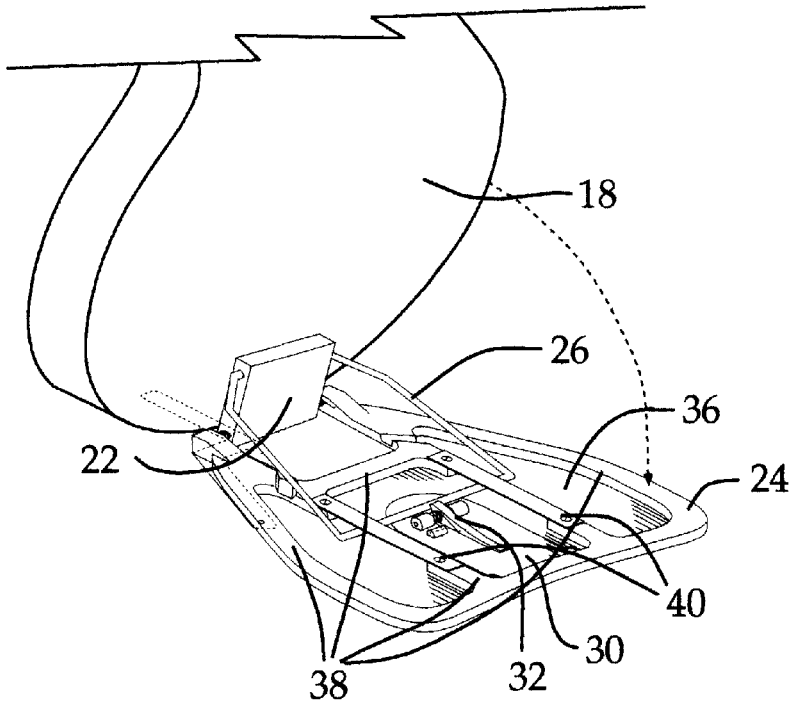
FIG. 2 is a perspective view illustrating the stand mounted on a guitar, with the stand in the open position.
Figure 4:
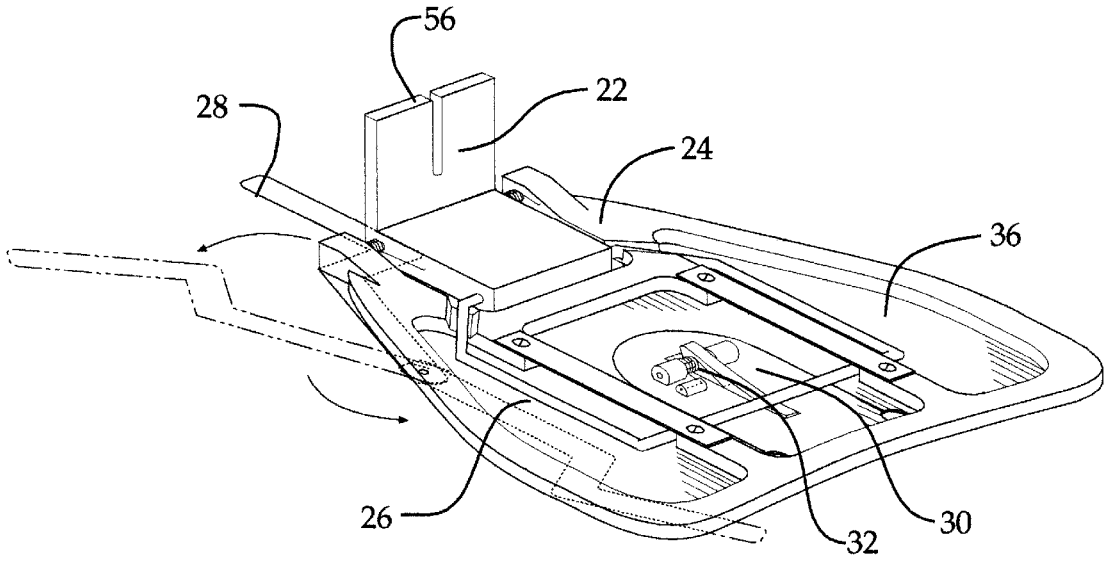
FIG. 4 is a perspective of the stand, removed from the instrument.

In the preferred embodiment of the present invention illustrated in FIG. 1 and FIG. 2, a support stand, generally indicated at 10, is adapted for supporting a conventional guitar indicated at 12, in a generally upright position. Guitar 12 includes a body 14, and a neck 16 (shown in FIGS. 7A through 7D). Body 14 includes a front portion (not shown), and a rear surface 18 which terminates at bottom edge 20. The stand 10 comprises an L shaped mounting block 22, a flat stand member 24, and a retaining clip 26. The flat stand member 24 includes a foot member 28, release tab 30, and catch assembly 32. Mounting block 22 includes slot 56 (See FIG. 4) which is slipped under the instrument's strap nut to facilitate mounting of stand 10 to instrument 12. As seen in FIG. 1, when the musical instrument 12 is in use, flat stand member 24 rests adjacent the instrument rear surface 18 in a closed position. Mounting block 22 is attached to the instrument bottom edge 20 by the instrument strap nut and screw indicated at 34. As shown in FIG. 2, when the instrument is not being played, flat stand member 24 is moved away from instrument rear surface 18 by a predetermined angle, and rests on a floor or other support surface in the open position.

Figure 3:
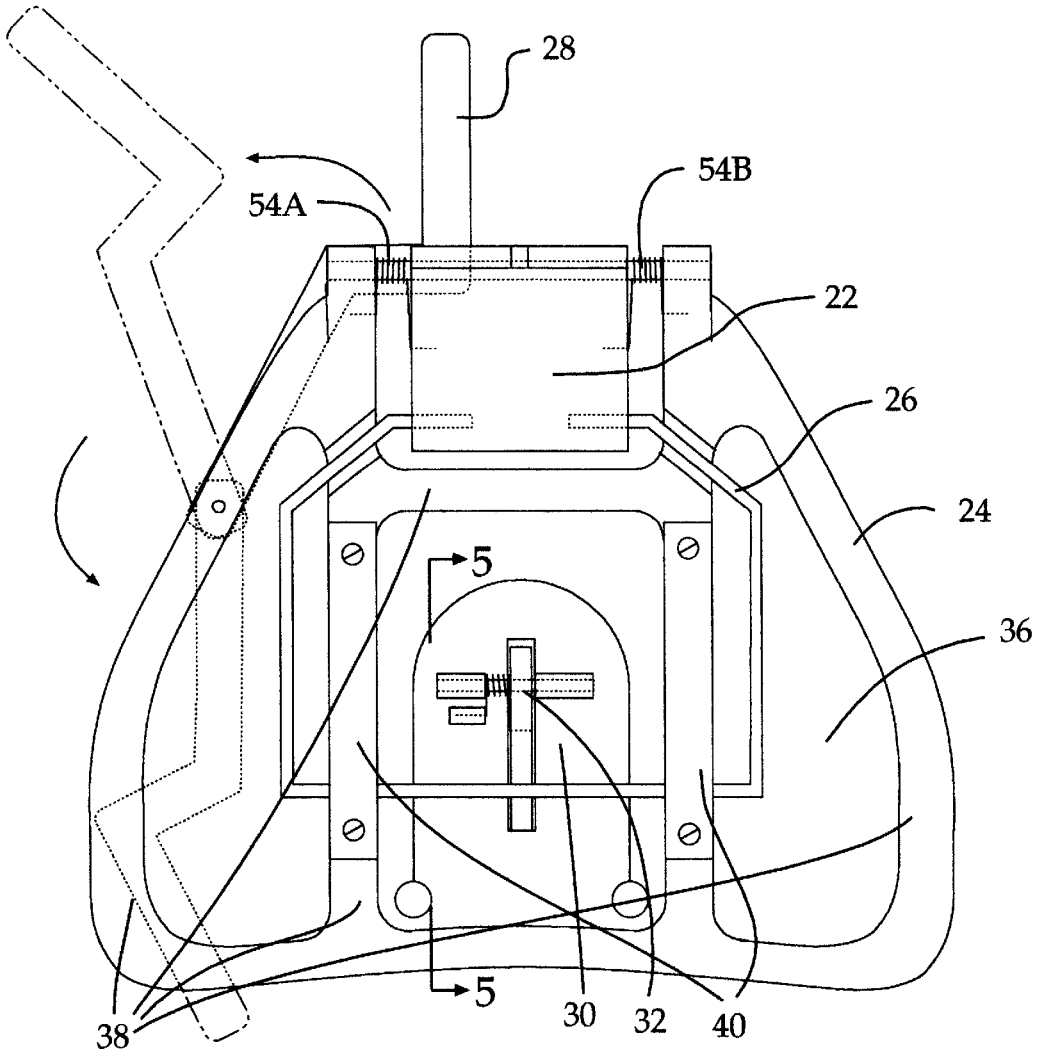
FIG. 3 is a straight-on view of the stand, removed from the instrument, showing the relative positions of the various elements of the stand.

As shown in FIG. 2 and FIG. 3, flat stand member 24 comprises base surface 36 and rib portions 38. As shown in FIG. 3, foot portion 28 is moveable between a deployed position and a stored position. Base surface 36 includes release tab 30 which is resilient and flexible a short distance between an unflexed and a flexed position. Clip guides 40 are attached to rib portions 38 such that retaining clip 26 can travel along the space between clip guides 40 and base surface 36 as the stand 10 is moved between open and closed position. Catch assembly 32 is positioned on release tab 30 such that retaining clip 26 encounters catch assembly 32 as stand 10 is moved between open and closed position. As seen in FIG. 3, springs 54A & B cause flat stand member 24 to return to closed position absent any force to the contrary.

Figure 6:
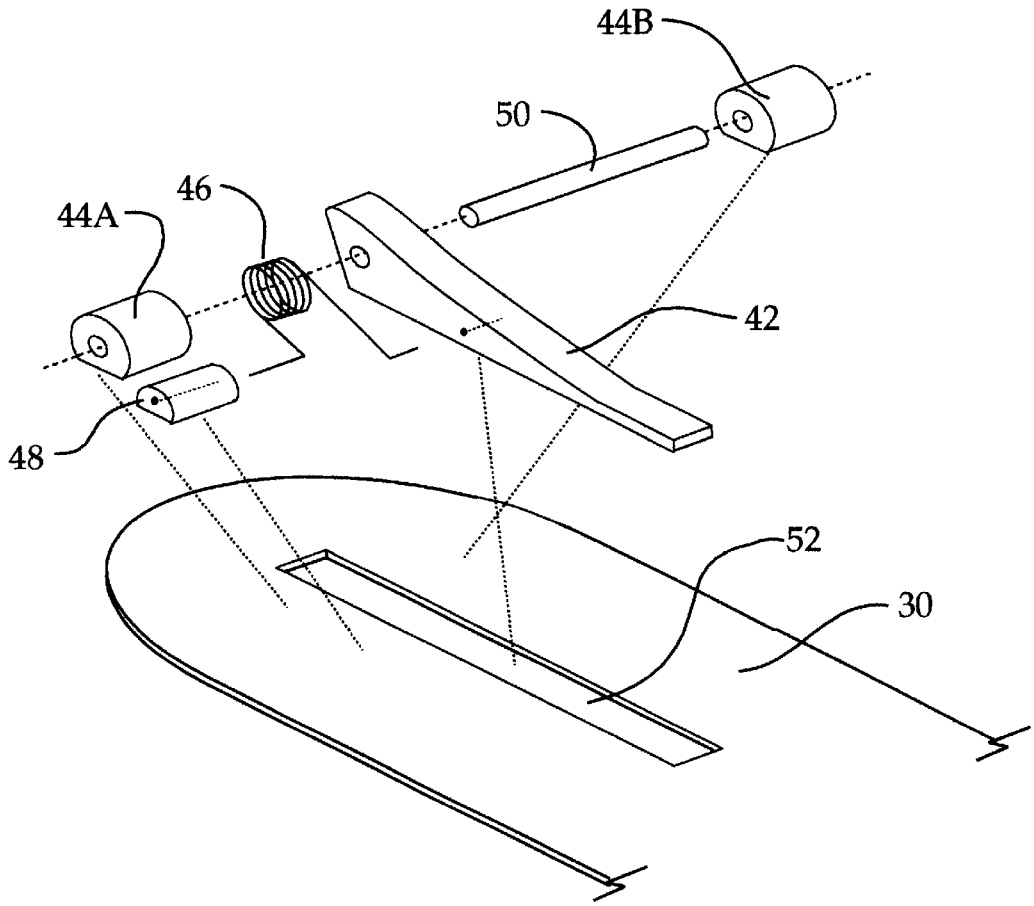
FIG. 6 is an exploded detail of the catch mechanism.

Referring now to FIG. 6, the detail of catch assembly 32 is seen. The catch assembly comprises catch cam 42, mounts 44A & B, spring 46, spring retainer 48, and pin 50. The components are assembled on release tab 30 such that catch cam 42 is moveable through opening 52 as it pivots on pin 50 between a neutral position wherein the bottom of catch cam 42 is even with and parallel to the plane of release tab 30, and a triggered position wherein the bottom of catch cam 42 is generally perpendicular to said plane.

Figure 5A:
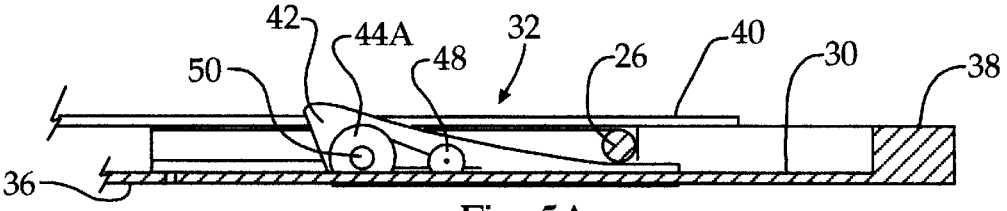
FIGS. 5A through 5D are cross sections taken at line 5—5 of FIG. 3, showing detail of the catch mechanism in various stages of operation.
Figure 5B:
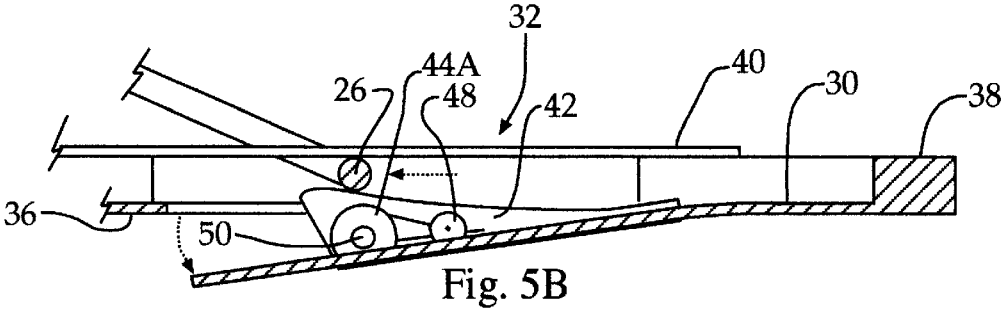
Figure 5C:
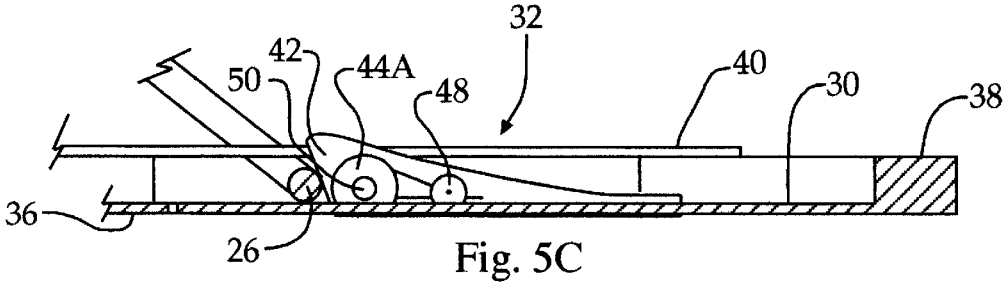
Figure 5D:
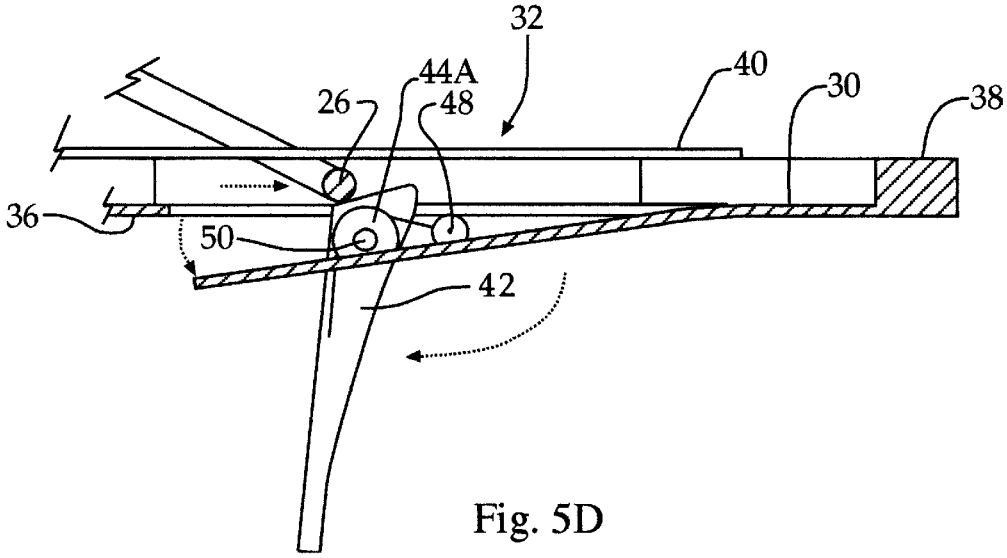

FIGS. 5A, 5B, 5C and 5D illustrate the function of the catch mechanism. FIG. 5A shows catch assembly 32 when stand 10 is in the closed position. In this circumstance, release tab 30 is in the unflexed position, and catch cam 42 is in the neutral position. FIG. 5B illustrates the action of the catch assembly 32 as the stand 10 is in transition between the closed position and the open position. As retaining clip 26 is drawn towards catch assembly 32, release tab 30 moves to the flexed position, allowing retaining clip 26 to pass over catch assembly 32 and continue traveling to the open position. FIG. 5C shows catch assembly 32 when stand 10 is the open position. In this circumstance, release tab 30 has returned to the unflexed position, and catch cam 42 has returned to the neutral position by virtue of spring 46. While resting on a floor or other support surface, catch cam 42 is prevented from pivoting on pin 50, thus retaining clip 26 is held from return to the closed position, thus locking the stand 10 in the open position until stand 10 is lifted from the floor. FIG. 5D illustrates the action of catch assembly 32 as the stand 10 is in transition between the open position and the closed position. As retaining clip 26 moves back toward the closed position, release tab 30 moves to the flexed position, and catch cam 42 pivots on pin 50 to the triggered position, allowing retaining clip 26 to pass over catch assembly 32 and return to the closed position. As retaining clip 26 passes catch assembly 32, release tab 30 returns to the unflexed position and catch cam 42 returns to the neutral position.

Operation—Preferred Embodiment

To use the instrument stand 10, one first attaches stand 10 to the instrument by loosening the screw which attaches the instrument's strap nut and slipping slot 56 under said nut and retightening the screw.

Figure 7A:
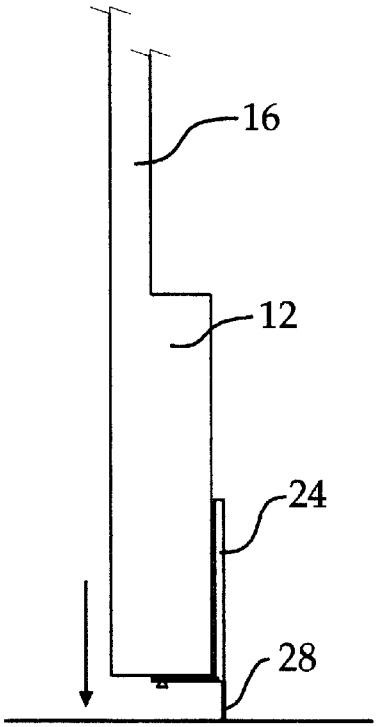
FIGS. 7A–7D show various stages of the stand during deployment.
Figure 7B:
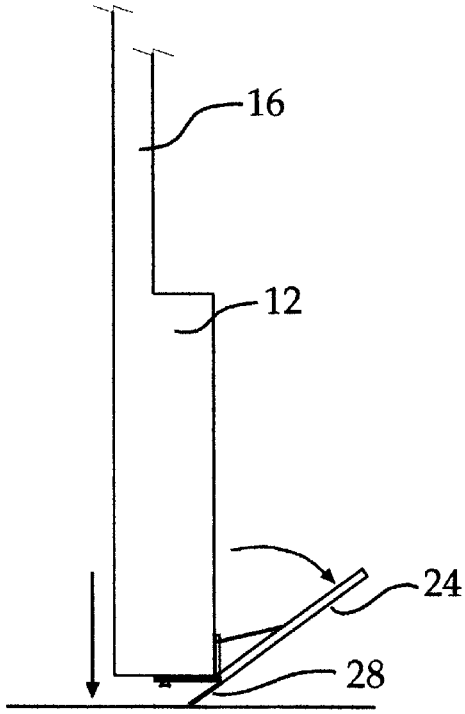
Figure 7C:
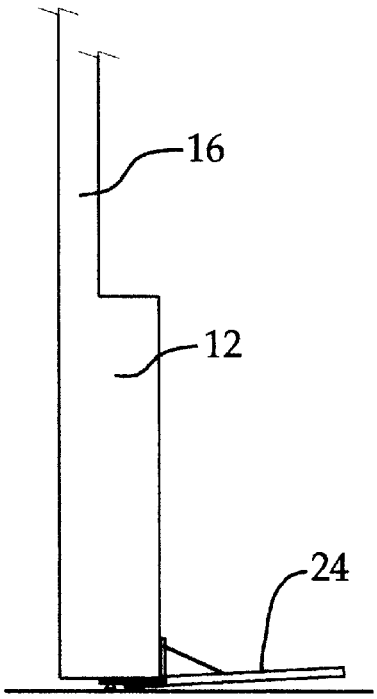
Figure 7D:
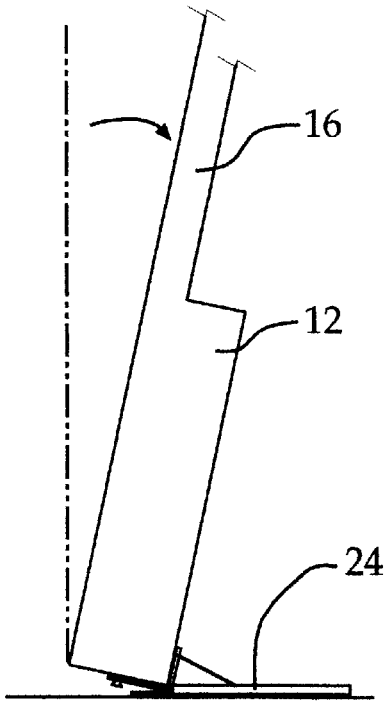

As illustrated in FIG. 7A, once stand 10 has been attached, one holds instrument 12 by gripping neck 15, positioning instrument 12 in a generally upright position above the floor. In this position instrument 12 is lowered until foot portion 28 contacts the floor. Exerting slight downward and rearward leverage on instrument 12 causes flat stand member 24 to be leveraged away from instrument rear surface 18 as illustrated in FIG. 7B. Continuing downward pressure, flat stand member 24 is leveraged to a position roughly parallell to the floor as shown in FIG. 7C. Now leaning instrument 12 slightly backward as shown in FIG. 7D, retaining clip 26 engages catch cam 42 as illustrated in FIG. 5C, locking stand 10 in the open position.

When istrument 12 is to be used, one simply lifts instrument 12 by neck 15, allowing catch cam 42 to rotate to the triggered position whereby retaining clip 26 is allowed to travel to the closed position, and whereby springs 54A & B (FIG. 3) pull flat stand member 24 adjacent to instrument rear surface 18 to the closed position.

Conclusion, Ramification and Scope of Invention

Thus the reader will see that the instrument stand of the invention provides a simple, convenient device which is easy to use and will fit a variety of instruments. It requires little manipulation by the user, and may be attached and removed easily from the instrument without damage thereto. When the instrument is being played, the stand is automatically and unobtrusively stored on the back of the instrument. The stand's design is simple and inexpensive to produce and maintain.

While my above description contains many specificities, these should not be construed as limitations on the scope of the invention, but rather as an exemplification of one preferred embodiment thereof Accordingly, the scope of the invention should be determined not by the embodiments illustrated, but by the appended claims and their legal equivalents.

What is claimed is:

1. A musical instrument stand for an instrument having a rear surface, a bottom edge and a strap nut and mounting screw, the stand comprising:

(a) an L shaped mounting block with two legs for mounting said stand to said instrument wherein one leg of said L shaped mounting block is disposed adjacent said rear surface and the remaining leg of said L shaped mounting block is disposed adjacent said bottom edge and secured thereon by said strap nut and mounting screw;

(b) a flat stand member pivotally attached to said L shaped mounting block and moveable between a first, closed position adjacent said rear surface and a second, open position spaced away from said rear surface by a predetermined angle;

(c) a retaining clip capable of retaining said stand in said second, open position;

(d) a catch assembly capable of alternately holding and releasing said retaining clip wherein said stand will remain in either said second, open position or return to said first, closed position, said catch assembly configured to contact a horizontal surface and exert a holding force to said retaining clip when said catch assembly is in contact with said surface, and to release said retaining clip upon removal of said catch assembly from said horizontal surface;

(e) a retracting means for retracting said stand to said first, closed position such that absent any preventative force, said stand will return to and remain in said first, closed position;

(f) engaging means for leveraging said stand into said second, open position, said engaging means configured to contact a horizontal surface and exert leverage therefrom to said flat stand member wherein said leverage causes said flat stand member to move from said first, closed position to said second, open position.

2. The stand of claim 1 wherein said retracting means comprises one or more springs.

3. The claim of stand 1 wherein said engaging means comprises a lever which is moveably attached to said flat stand member and is moveable between a deployment position and a storage position.

* * * * *